US009663272B1

(12) United States Patent
Smith

(10) Patent No.: US 9,663,272 B1
(45) Date of Patent: May 30, 2017

(54) APPARATUS FOR HOLDING A TRASH BAG OPEN

(71) Applicant: Michael Raymond Smith, Houston, TX (US)

(72) Inventor: Michael Raymond Smith, Houston, TX (US)

( * ) Notice: Subject to any disclaimer, the term of this patent is extended or adjusted under 35 U.S.C. 154(b) by 0 days.

(21) Appl. No.: 15/088,965

(22) Filed: Apr. 1, 2016

(51) Int. Cl.
*B65D 33/00* (2006.01)

(52) U.S. Cl.
CPC ..... *B65D 33/007* (2013.01)

(58) Field of Classification Search
CPC ..... B65D 33/007
USPC ..... 383/33–34.1; 248/99–101
See application file for complete search history.

(56) References Cited

U.S. PATENT DOCUMENTS 3,638,888 A 2/1972 Ross
3,744,081 A * 7/1973 Miller ..... A01G 1/12 15/257.1
3,754,785 A * 8/1973 Anderson ..... A47L 13/52 248/99
4,052,764 A * 10/1977 Groff ..... A47L 13/52 15/257.9
4,174,085 A * 11/1979 Ferreira ..... B65B 67/1205 108/11
4,269,441 A 5/1981 Hirsch
4,548,372 A 10/1985 Lutzker
4,884,603 A * 12/1989 Simpson ..... B65B 67/1238 141/10
5,005,791 A * 4/1991 Lanzen ..... B65B 67/1211 248/99
5,009,378 A * 4/1991 Linsmeyer ..... B65B 67/12 248/99
5,106,041 A * 4/1992 Jelincic ..... B65B 67/12 141/316
5,308,027 A * 5/1994 Fullilove ..... B65B 67/12 248/101
5,323,990 A 6/1994 Graves
6,007,030 A 12/1999 Judge
6,450,461 B1 9/2002 Lohmann
7,677,508 B1 3/2010 Owens
7,686,260 B1 * 3/2010 Tetradis ..... B62B 1/142 248/100
7,744,044 B2 * 6/2010 Gabriel ..... A01G 1/125 220/495.08
2007/0235598 A1 * 10/2007 Smith ..... B65B 67/1238 248/95
2008/0309038 A1 12/2008 Gilligan
(Continued)

*Primary Examiner* — Jes F Pascua
(74) *Attorney, Agent, or Firm* — Egbert Law Offices, PLLC

(57) ABSTRACT

An apparatus for maintaining a bag in an open configuration has a base with a forward end and a rearward end, a first arm pivotally mounted to the adjacent to the rearward end of the base, and a second arm pivotally mounted adjacent to the rearward end of the base in spaced relation to the first arm. The first arm is movable between a generally horizontal first position and a second position extending at an obtuse angle with respect to said base. The second arm is movable between a generally horizontal first position and a second position extending at an obtuse angle with respect to the base. The first and second arms are adapted to receive an open end of the bag thereon. The base has a top surface that is inclined upwardly from the forward end toward the rearward end.

17 Claims, 6 Drawing Sheets

(56) References Cited

U.S. PATENT DOCUMENTS

2013/0320159 A1* 12/2013 Clark ..... B65F 1/002
248/99

* cited by examiner

APPARATUS FOR HOLDING A TRASH BAG OPEN

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to trash bag holders. More particularly, the present invention relates to trash bag holders that hold the trash bag open while the trash bag is in a horizontal orientation. More particularly, the present invention relates to trash bag holders that include arms that are foldable so as to extend in order to receive an open end of a trash bag therein.

2. Description of Related Art Including Information Disclosed Under 37 CFR 1.97 And 37 CFR 1.98.

In certain wooded regions of the country, autumn brings with it beautifully colored leaves which fall from the trees and accumulate on the ground. Often, home owners will, for either aesthetic or fire-prevention reasons, choose to rake up and remove the leaves from the lawns. Traditionally, the leaves have been raked into a large pile and then the homeowner repeatedly stoops over to pick up armfuls of leaves which are usually placed in a vertically-oriented trash receptacle, usually a bushel basket, a trash can, or a plastic trash bag which is held open by another person or biomechanical apparatus. This job becomes particularly difficult for someone with a large volume of leaves to remove or someone that has a bad back.

To address these problems, various devices have been created for raking leaves into a horizontally-oriented trash receptacle. However, a horizontally-oriented trash receptacle cannot be fully filled because the leaves tend to fall out of the vertical opening or mouth of the trash receptacle. In addition, once the leaves have been raked into the horizontally-oriented trash receptacle, the trash receptacle must be pulled up and placed into a vertical position in order to secure the opening in the trash receptacle to prevent the leaves from falling out. In order to accomplish this, the homeowner must bend over and squat down. This can result in back and leg strain. Another problem with these devices and their horizontally-oriented trash receptacles is that they tend to move along the ground as leaves are raked against them. Also, as the rake encounters these devices, the angle tips of the leaf rake's teeth tend to get caught between the ground and the device, causing the device to be pulled backward along the ground by the leaf rakes.

In the past, various patents have issued with respect to trash bag holding devices. For example, U.S. Pat. No. 3,638,888, issued on Feb. 1, 1972 to J. A. Ross, describes a foldable wire framework for supporting a plastic refuse bag in either a vertical or horizontal orientation. The bag holder includes top and bottom rectilinear frame members that are pivotally attached to a rectilinear upright. The top and bottom frame members fold, respectively, downwardly and upwardly flat against the backside of the upright member for convenient storage. The holder is adapted to support a plastic bag in such a manner that it can be laid on its side with the upright member upon the ground whereby the opening of the bags in a convenient position to receive leaves and debris that are swept into the opening. After the debris has been swept within the bag, the top frame functions as a handle in which to raise the entire holder in bag to a vertical position so as to allow the debris to fall to the bottom of the bag.

U.S. Pat. No. 4,269,441, issued on May 26, 1981 to H. M. Hirsch, shows a trash bag holder that comprises a bag-retaining frame and a handle that mounts on the frame after the bag has been inserted on the frame.

U.S. Pat. No. 4,548,372, issued on Oct. 22, 1985 to R. S. Lutzker, shows a lawn bag holder that includes three tubular rods connected end-to-end by sections of flexible tubing forming a triangular frame onto which the edges of a lawn bag are secured in order to maintain the lawn bag in a wide open position. Elongated resilient clips are used to secure the lawn bag to the frame so as to maintain the lawn bag in a wide open position.

U.S. Pat. No. 5,323,990, issued on Jun. 28, 1994 to D. A. Graves, provides a leaframp and bag holder device for assisting a person in raking leaves into a vertically-oriented trash container. The device includes a blunt-nosed ramp upon which the leaves are raked by using a conventional leaf rake. Once at the top of the ramp, the leaves fall by gravity through an opening provided in the device either into a trash bag previously secured to the opening by means of a lid portion or into a free-standing trash receptacle previously positioned under the device. Rear legs provided on the device have pointed lower ends to anchor the device to the ground and a foot rest is provided at the front of the device to hold the device against the ground while in use.

U.S. Pat. No. 6,007,030, issued on Dec. 28, 1999 to J. A. Judge, shows describes a trash bag holder and expanding form that is made from a sheet of stiff material that has at least three panels to hold the bag in an erect condition and to expand the opening of the bag into a shape that will allow the user to fill the bag with leaves or trash without having to hold the bag. The panels are separated by parallel, vertically-disposed score lines that act as fold lines or hinges between the panels of the holder. The panels are proportioned so that the sheet material can be folded flat with the panels lying against one another. When the device is folded into its operational configuration, the score lines act as corners such that the form is tubular or U-shaped with open ends and braces that hold the panels in an extended opposing relationship.

U.S. Pat. No. 6,450,461, issued on Sep. 17, 2002 to K. S. Lohmann, provides a trash bag holder for holding open and facilitating the filling of a trash bag with leaves, grass, debris or the like. The device is comprised of a frame including a top wall, a bottom wall, and at least one set of opposite side walls. An entry end and an exit end have a hollow interior area extending therebetween. The side walls are provided with holes therethrough proximate the entry end. The holes have corresponding slits. The frame is configured to receive, on its exit end, a specially-configured trash bag having two knots tied within the opening edge of the bag. The bag is placed upon the exterior of the exit end of the frame and pulled toward the entry and so that the knots of the bag line up with the holes of the side walls. The knots are pulled through the holes and retained in the corresponding slits such that the bag is securely retained on the frame which maintains the bag and a fully open position on the ground or floor surface so as to facilitate sweeping or raking of grass, leaves, garbage, and other debris into the bag.

U.S. Pat. No. 7,677,508, issued on Mar. 16, 2010 to A. Owens, teaches an easy-sweep trash bag holder for the easy pickup and removal of leaves on a ground surface. The bag holder is a self-standing frame that has a pair of adjustable legs to allow the back holder to stand upward by itself. An attached clip holds a garbage bag in place in an open position so that leaves may easily be swept or blown into the bag.

U.S. Application Publication No. 2008/0309038, published on Dec. 18, 2008 to J. Gilligan, shows a trash bag holder and transporter. A rim is provided with a frame. A foot peg pushes the end of the rim into the ground. An adjustable clamp assembly allows for the attaching of the trash bag positioned in the rim. An elongated strip of rigid material is attached from the rim to the wheel base to support the trash bag.

It is an object of the present invention to provide an apparatus that allows trash bags to be maintained open when in a horizontal orientation.

It is another object of the present invention to provide an apparatus that facilitates the collection of leaves and other debris.

It is another object of the present invention to provide an apparatus that allows a person that rake leaves and other debris into a trash bag without the need to hold the trash bag open with one hand.

It is another object of the present invention to provide an apparatus which is easily deployable.

It is another object of the present invention to provide an apparatus that folds compactly.

It is still further object of the present invention to provide an apparatus that can be easily stored.

It is a further object of the present invention to provide an apparatus that operates in the manner of a dustpan.

It is still further object the present invention provide an apparatus that is easy to use, relatively inexpensive and easy to manufacture.

These and other objects and advantages of the present invention will become apparent from a reading of the attached specification and appended claims.

BRIEF SUMMARY OF THE INVENTION

The present invention is a apparatus for maintaining a bag in an open configuration that comprises a base having a forward end and a rearward end, a first arm pivotally mounted adjacent the rear end of the base, and a second arm pivotally mounted adjacent the rear end of the base in spaced relation to the first arm. The first arm is movable between a generally horizontal first position and a second position extending at an obtuse angle with respect to the base. The second arm is also movable between a generally horizontal first position and a second position extending at an obtuse angle with respect to the base. The first and second arms are adapted to receive an opening of the bag therein.

The base includes a planar bottom surface and a top surface that is inclined upwardly from the forward and toward the rearward end. The base has a first pad extending outwardly from one side thereof and a second pad extending outwardly from an opposite side thereof. Each of the first and second pads has a bottom surface that is coplanar with the bottom surface of the base. Each of the first and second pads are adjacent to the rearward end of the base.

The first arm is pivotally connected to the base at a location that is closer to the rearward end than a location that the second arm is pivotally connected to the base. The base has a first slot and a second slot adjacent to the rearward end of the base. The first arm has an end received in the first slot when the first arm is in the second position. The second arm has an end received in the second slot when the second arm is in the second position.

The first pair of plates are affixed to the base and extend upwardly therefrom. The first arm is pivotally connected between the first pair of plates. A second pair of plates are affixed to the base and extend upwardly therefrom. The second arm is pivotally connected between the second pair of plates. A first pin assembly connects the first arm to the first pair of plates. A second pin assembly connects the second arm to the second pair of plates. Each of the first and second pin assemblies includes at least one tube having an inner wall. The tube is affixed to the arm and extends through at least one of the pair of plates. An insert element is engaged within an interior of the tube. The insert element has a surface bearing against one of the pair of plates. The tube has a shoulder element inward of one end of the tube. The first insert element has a conical portion having a shoulder bearing against the shoulder element of the tube.

Each of the plates of the first and second pair of plates has a J-shaped slot having an upper end and a lower end and a bottom surface between the first and second ends. The pin assembly resides against the bottom surface when the arm is in the second position. The pin assembly resides against the lower end of the J-shaped slot when the arm is in the first position. The first arm resides adjacent to a side of and rearward of the second arm when the first arm and the second arm are in the first position. The first arm has an end away from the base when in the second position. The second arm has an end away from the base when in the second position. These ends of the first and second arms have no structure therebetween.

The open end of the bag has an interior surface positioned against the first and second arms when the first and second arms are in the second position. The base is adapted to be positioned against an underlying surface. The interior surface of the bag is interposed between the bottom of the base and this underlying surface. The interior surface of the bag bears against the ends of the first and second arms when the first and second arms are in the second position. In the preferred embodiment the present invention, the bag is a trash bag. The open end of the trash bag opens so as to face toward the first and second arms and the base. The rearward end of the base is positioned interior of the bag. Slots are formed between the first pad and the base and between the second pad and the base. The bag has an edge at the open end that is positioned within the slots.

This foregoing Section is intended to describe, with particularity, the preferred embodiment of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
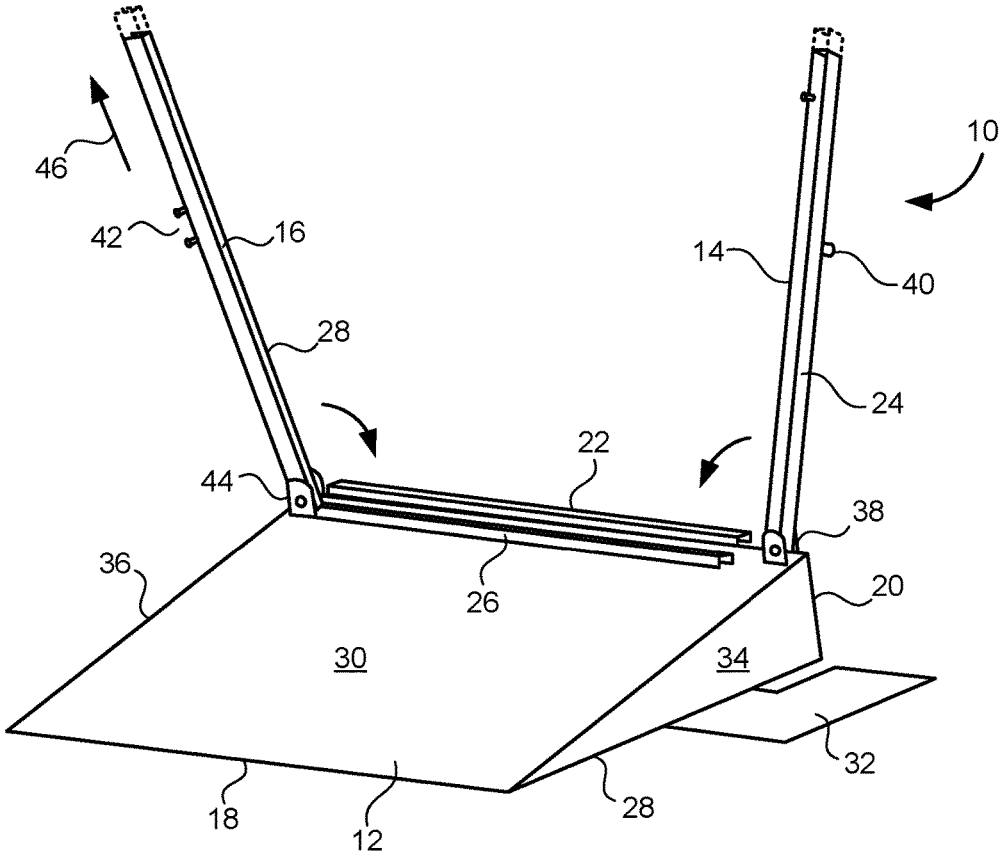
FIG. 1 is a perspective view of the apparatus the present invention showing the arms as being movable between a first position and a second position.

Referring to FIG. 1, there shown the apparatus 10 for holding a bag open while in a horizontal orientation. The apparatus 10 includes a base 12, a first arm 14 and a second arm 16. The base 12 has a forward end 18 and a rearward end 20. The first arm 14 is pivotally mounted to the base 12 adjacent to the rear end 20 of the base 12. As can be seen, the first arm 14 is movable between a generally horizontal orientation 22 and a second position 24 which extends at a slightly obtuse angle with respect to the base 12. The second arms 16 is also pivotally mounted to the base 12 adjacent to the rearward end 20 of the base 12. The second arm 16 is movable between a generally horizontal first position 26 and a second position 28 which extends outwardly of the base 12 at a slightly obtuse angle.

In FIG. 1, it can be seen that the base 12 has a generally planar bottom surface 28 suitable for being positioned on an underlying surface, such as the earth. The base 12 also includes a top surface 30 that is inclined upwardly from the forward end 18 toward the rearward end 20. As such, the top surface 30 forms a ramp for the raking of leaves into a trash bag supported on the arms 14 and 16. The very narrow thickness at the forward end 18 serves to urge the leaves upwardly by a raking action and ultimately, the leaves will fall into the trash bag once it passes the elevated rearward end 20 of the base 12. A first pad 32 extends outwardly of a side 34 of the base 12. Another pad (not shown) will extend outwardly of the opposite side 36 of the base 12. The pads, such as pad 32, allow the user to place his or her feet on the pads while raking leaves into a bag supported by the arms 14 and 16. The pad 32 is planar with the bottom surface 28 of the base 12. The pad 32 is located generally adjacent to the rearward end 20 of the base 12. By placing a person's weight upon the pads, the bottom surface 28 is urged outwardly toward the earth such that the forward end 18 resides tightly against the earth. As such, the angled ends of the rake are prevented from getting hung up on the forward end 18 of the base 12.

In FIG. 1, it can be seen that when the arms 14 and 16 are folded into the first position (indicated by reference numerals 22 and 26), the arms 14 and 16 will be in a horizontal orientation and reside upon the top surface 30 of the base 12. Arm 14 is pivotally connected to the base 12 in a location rearward of the pivotal connection of the second arm 16 with respect to the base 12. As such, when in the first position, the first arm 14 will reside rearwardly and in generally parallel relationship to the second arm 16. As such, a very neat folded configuration is accomplished when the arms 14 and 16 are moved to the first position.

The first arm 14 is pivotally connected to a pivotal connection 38. As such, the arm 14 can be pivoted upwardly to the position shown by reference numeral 24. Small protrusions 40 extend outwardly of the arm 14 so as to engage with the trash bag placed thereover. Similar protrusions 42 extend outwardly of the second arm 16 so as to likewise engage with a bag placed thereagainst. The second arm 16 is connected to the base 12 at pivotal connection 44.

FIG. 1 illustrates that the first arm 14 and the second arm 16 can be movable upwardly as indicated by arrow 46. This upward movement is accomplished so as to ultimately allow the arms 14 and 16 to be move downwardly into respective slots formed in the base 12. Once the lower end of each of the arms 14 and 16 is placed into these slots, the arms 14 and 16 are maintained rigidly in the second position. This procedure will be described hereinafter.

Figure 2:
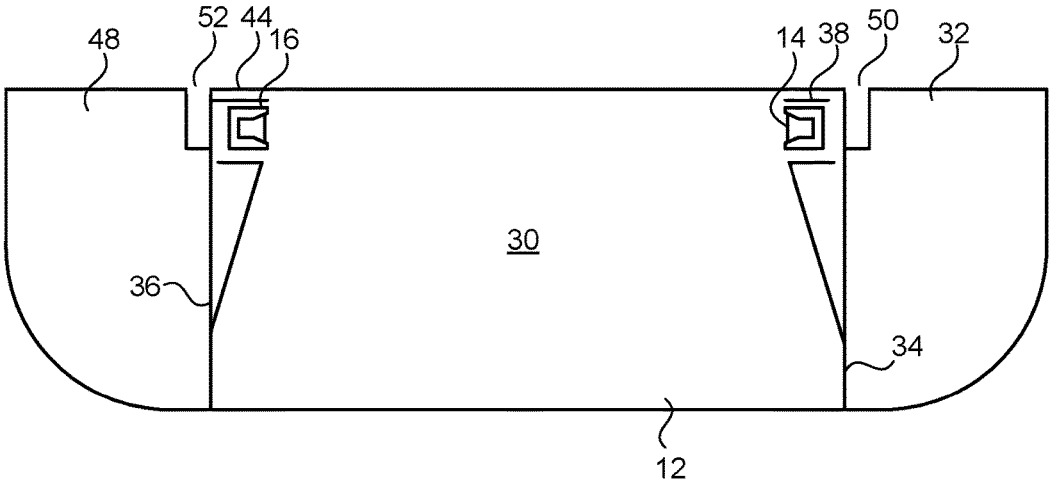
FIG. 2 is a plan view of the base of the apparatus of the present invention.

FIG. 2 specifically illustrates the top surface 30 of the base 12. The pad 32 is illustrated as extending outwardly from side 34 of the base 12. Another pad 48 is illustrated as extending outwardly of the side 36 of the base 30. The first arm 14 is illustrated as pivotally connected at pivotal connection 38 to the base 12. Similarly, the second arm 16 is illustrated as maintained at the pivotal connection 44.

Importantly, in FIG. 2, there is a small slot 50 formed between the pad 32 and the side 34 of base 12. Another small slot 52 is formed between the pad 48 and the side 36 of the base 12. Slots 50 and 52 serve to receive an edge of a bag that is placed therein.

Figure 3:
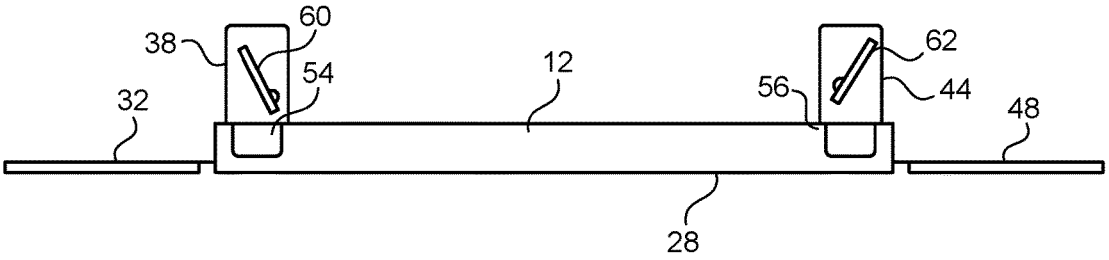
FIG. 3 is a rearward view of the base of the apparatus of the present invention.

FIG. 3 particularly illustrates the nature of the pivotal connections 44 and 38. It can be seen that there is a slot 54 that is formed in the base 12 at the pivotal connection 38. Another slot 56 is formed in the base 12 adjacent to the pivotal connection 44. Slots 54 and 56 serve to receive the ends of the respective first arm 14 and second arm 16 therein when the arms 14 and 16 are in the second position. The pad 32 extends outwardly of a side of the base 12. The pad 48 also extends outwardly of the opposite side of the base 12. It can be seen that the bottom surfaces of each of the pads 32 and 48 is coplanar with the bottom surface 28 of the base 12. FIG. 3 further shows that the pads 32 and 48 can be connected by a hinge, such as a living hinge, to the respective sides of the base 12. As such, these pads 32 and 48 can be neatly folded into a compact configuration with the base 12.

In FIG. 3, it can be seen that there is a J-shaped slot 60 formed at the pivotal connection 38. Another J-shaped slot 62 is formed at the pivotal connection 44. J-shaped slots 60 and 62 allow the respective arms 14 and 16 to move between the first position and the second position. A more detailed illustration of this configuration is shown in FIG. 6.

Figure 4:
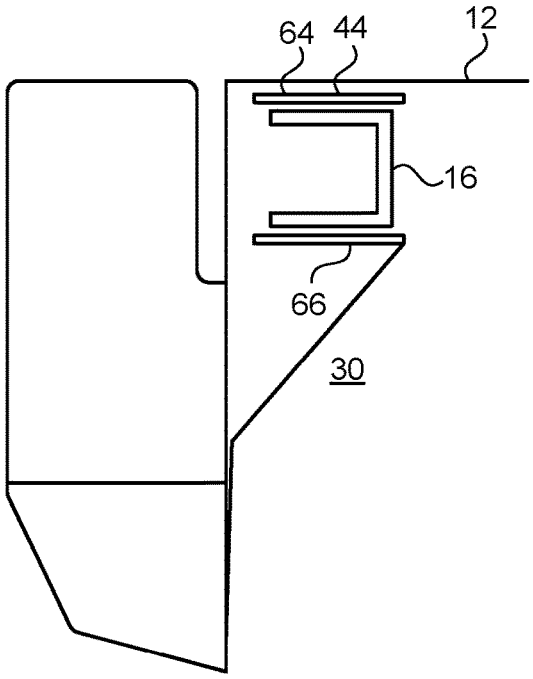
FIG. 4 is a partial plan view showing the relationship between the arm and the pair of plates extending upwardly from the base of the apparatus of the present invention.

FIG. 4 is an illustration of the pivotal connection 44 for the second arm 16. Pivotal connection 44 includes a first plate 64 and a second plate 66 that extends upwardly from the top surface 30 of the base 12. The second arm 16 has a U-shaped configuration and is positioned between the plates 64 and 66. The pivotal connection 38 for the first arm 14 will have a similar configuration to that shown for the second arm 16 in FIG. 4.

Figure 5:
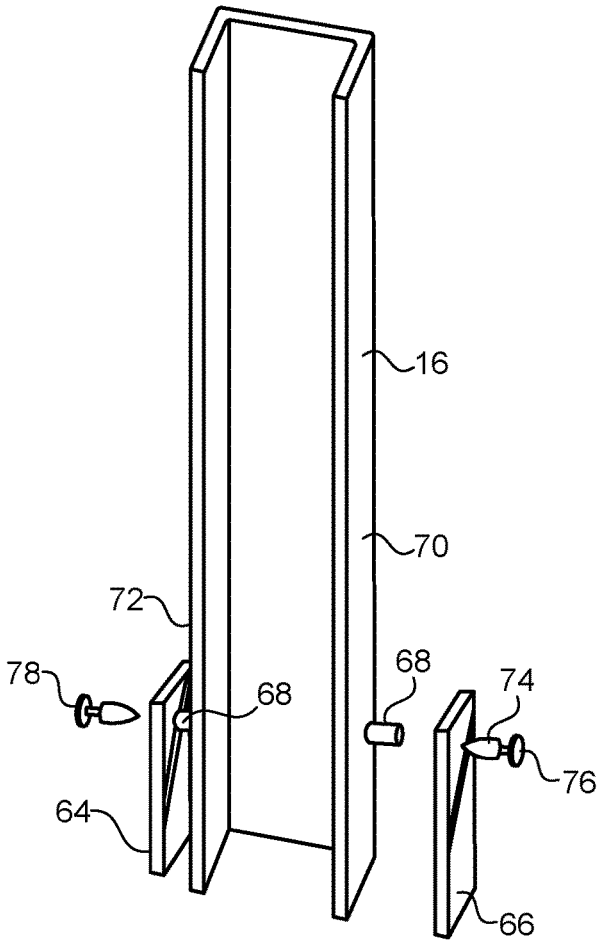
FIG. 5 is an exploded view showing the manner of connection between the arm and the pair of plates.

FIG. 5 specifically illustrates how the second arm 16 is connected to the respective plates 64 and 66. The arm 16 has a first tubular member 68 extending outwardly from side 70. Another tubular member will extend outwardly from the side 72 of arm 16. The slots on each of the plates 64 and 66 are respectively placed over the tubular members 68. An insert element 74 is then inserted into the interior of the tubular member 68 such that a head 76 of insert element 74 will bear against the outer surface of the plate 66. Another insert element 78 can be utilized with the other tubular members 68. As such, the pivotal connection between the arm 16 and the pair of plate 64 and 66 is shown.

Figure 6:
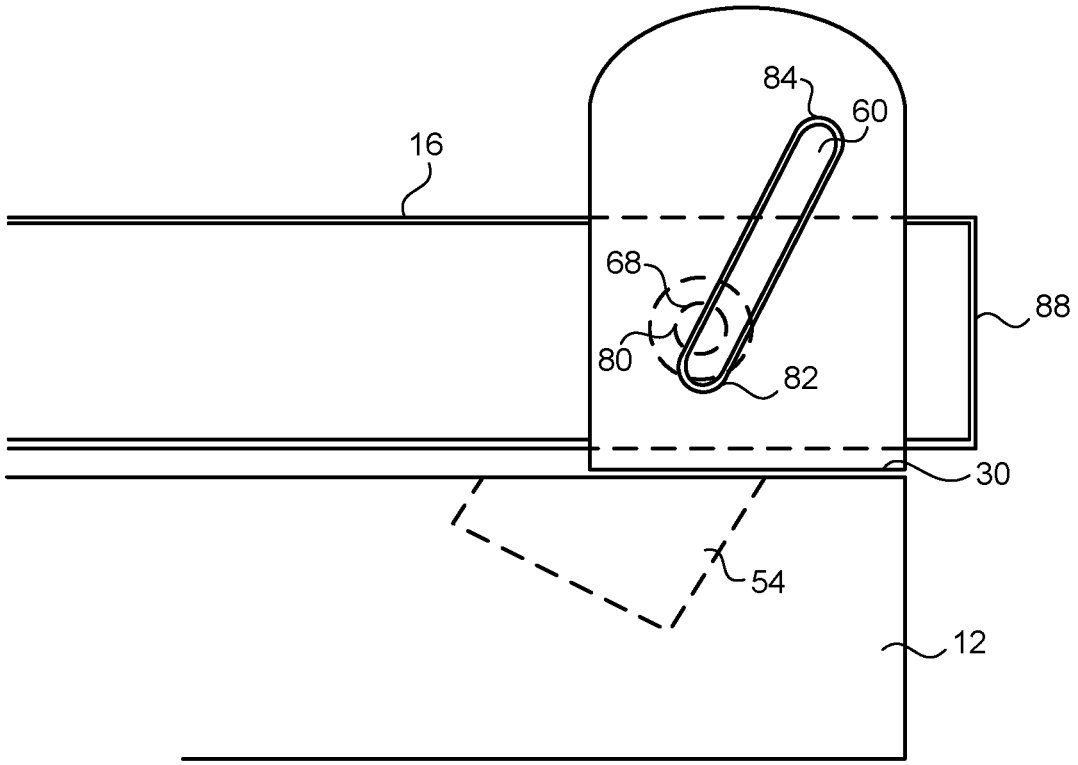
FIG. 6 is a partially cross-sectional view showing the orientation of the slot within the base and in relation to one of the plates extending upwardly from the base of the apparatus of the present invention.

FIG. 6 illustrates how the second arm 16 is received within the J-shaped slot 60. FIG. 6 further shows how the slot 54 extends at an angle into the base 12. In FIG. 12, the second arm 16 is illustrated in its first position generally oriented horizontally. In this position, the tubular member 68 will reside in a lower end 80 of the J-shaped slot 60. The J-shaped slot 60 further includes a bottom surface 82 and an upper end 84. So as to cause the necessary movement of the arm 16 from the first position to the second position, a downward force is first applied to the arm 16 so as to cause the tubular member 68 to move toward the bottom surface 82. Ultimately, the arm 16 will be pulled upwardly along the J-shaped slot until the tubular member 68 will reside in the position adjacent to the upper end 84. This lifting action will cause the end 88 of the arm 16 to properly be pivoted upwardly and free of the top surface 30 of the base 12. The arm 16 can then be lowered such that the tubular member 68 moves downwardly along the J-shaped slot 60 so that the lower end 88 will bottom out in the slot 54. In this position, the tubular member 68 will reside against the bottom surface 82 of the J-shaped slot. The slot 54 in the base 12 assures that the arm 16 is rigidly oriented at an obtuse angle in the second position. A similar arrangement occurs with respect to the first arm 14.

Figure 7:
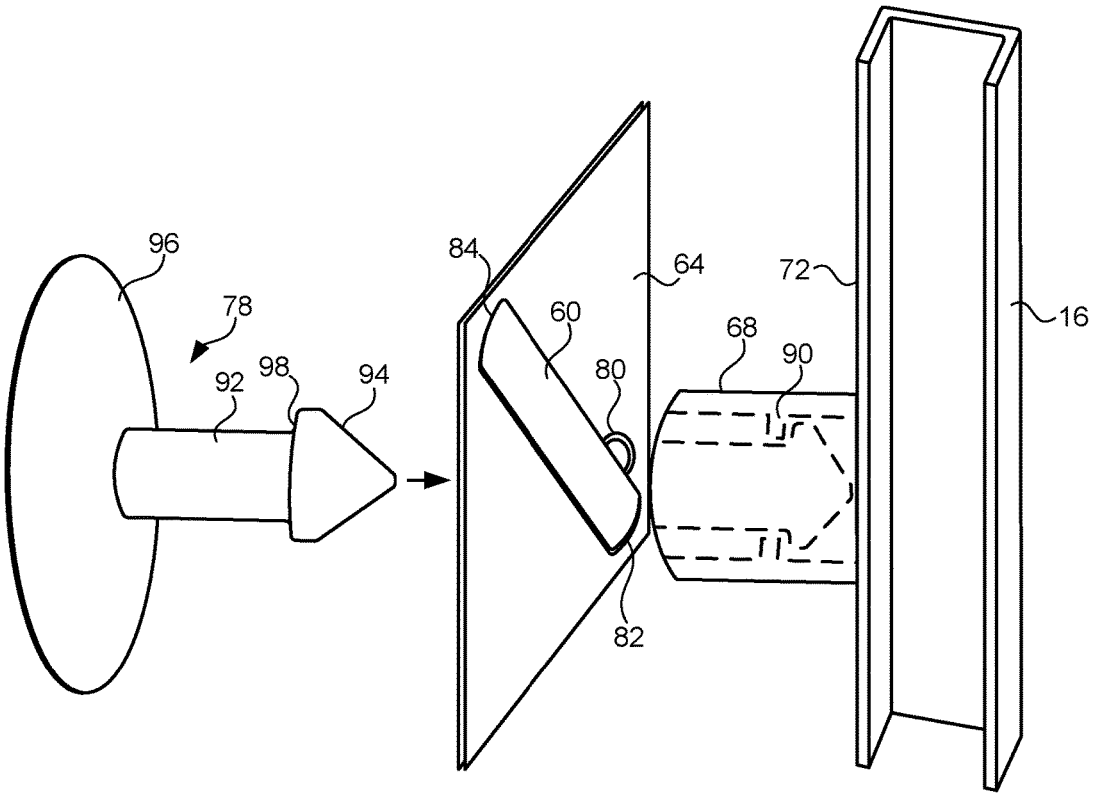
FIG. 7 is an exploded view showing the pin assembly is used in association with the present invention.

FIG. 7 particularly illustrates the specific configuration of the pin assembly used for causing the pivotal connection between the arm 16 and the base. In particular, the pin assembly shown in FIG. 7 includes the tubular member 68 which is affixed to the side 72 of the arm 16. The tubular member 68 includes a shoulder element 90 formed on the interior of the tubular element 68. The plate 64 has the J-shaped slot 60 therein. The J-shaped slot 60 will be positioned over the tubular element 68. The J-shaped slot is illustrated as having the upper end 84, the bottom surface 82 and the lower end 80. The insert element 78 has a shaft 92 with a conical-shaped member 94 at the end of the shaft 92. A head 96 is formed at the opposite end of the shaft 92. The conical member 94 is inserted into the interior of the tubular element 68 such that the conical member 94 will pass the shoulder element 90 such that a shoulder 98 of the conical member 94 will bear against the shoulder element 90 (as illustrated in broken-line fashion). The head 96 will then bear against the plate 64. The insert element 78 can be formed of an elastomeric material that can suitably deform such that the conical member 94 will properly reside in the position shown in broken line fashion in FIG. 7.

Figure 8:
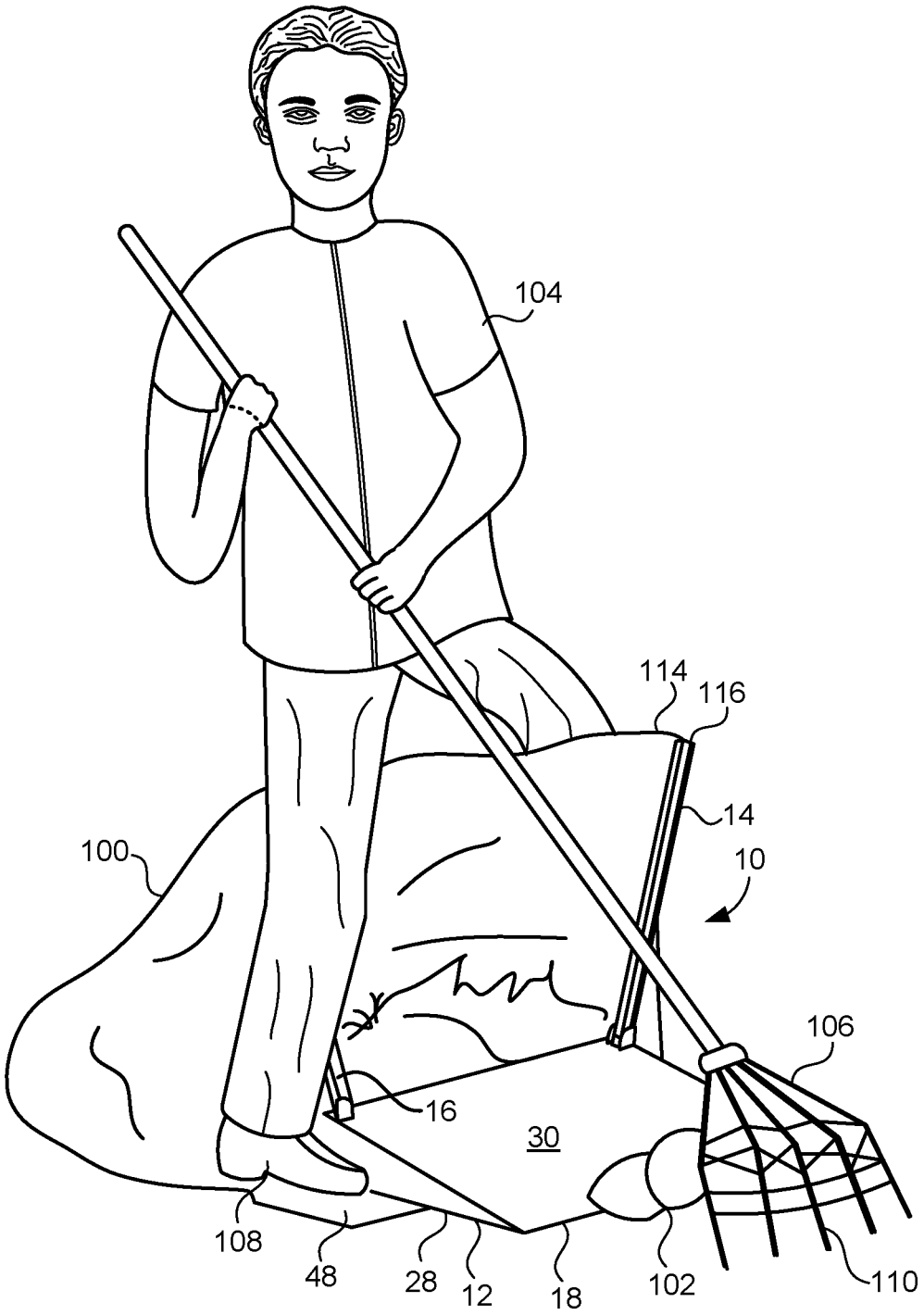
FIG. 8 is an illustration of the use of the present invention when raking leaves.

FIG. 8 shows an illustration showing how the apparatus 10 of the present invention is used in association with a bag 100 for the raking of leaves 102. In particular, a person 104 has a rake 106. The rake 106 is used so as to urge the leaves 102 upon the base 12 and along the top surface 30 of the base 12. A foot 108 of the person 104 is placed upon the pad 48. Another foot of the person 104 will be placed upon the pad 32 at the opposite side of the base 12. As such, the base 12 is rigidly secured against an underlying surface, such as the earth. This will cause the forward edge 18 of the base 12 to be tightly urged against the earth so that the pointed ends 110 of the rake 106 will not hang up on this edge 18.

The arms 14 and 16 are illustrated in the second position extending upwardly at an obtuse angle with respect to the base 12. The trash bag 100 has an open end 114 which is extended around the top end 116 of the arm 14 and also over the top end of the arm 16. The open end 114 of the bag 100 will drape along the sides of each of the arm 16 and ultimately be inserted into the slots 50 and 52 of the base 12. As such, a bottom portion of the open end 114 will reside within the slots 50 and 52 so as to extend over the bottom surface 28 of the base 12 and be secured by the weight of the person 104.

The person 104 can continue to rake leaves into the open end 114 of the trash bag 100 until a desired filling of the trash bag is accomplished. The weight of the person 104 can then be removed from the pads 32 and 48 so that the open end 114 can be separated from the arms 14 and 16. The bag can then be lifted, closed and transported elsewhere. The arms 14 and 16 can then be folded downwardly to the first position and the pads 32 and 40 can be folded so that the apparatus 100 can be compactly stored.

It is important to note that there is no structure extending between the upper ends of the arms 14 and 16. Experiments with the present invention and proven that it is unnecessary to include such a structure in the present invention. The pressure caused by the outwardly extending arms 14 and 16 upon the open end 114 of the bag 100 is sufficient to keep the bag 100 in its open configuration.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus for maintaining a bag in an open configuration, the apparatus comprising:

a base having a forward end and a rearward end;

a first arm pivotally mounted adjacent said rearward end of said base, said first arm movable between a generally horizontal first position and a second position extending at an obtuse angle with respect to said base; and a second arm pivotally mounted adjacent said rearward end of said base in spaced relation to said first arm, said second arm movable between a generally horizontal first position and a second position extending at an obtuse angle with respect to said base, said first and second arms adapted to receive an open end of the bag thereon, said base having a first slot and a second slot adjacent said rearward end of said base, said first arm having an end received in said first slot when said first arm is in said second position, said second arm having an end received in said second slot when said second arm is in said second position.

2. The apparatus of claim 1, said base having a planar bottom surface and a top surface that is inclined upwardly from said forward end toward said rearward end.

3. The apparatus of claim 1, said base having a first pad extending outwardly from one side thereof and a second pad extending outwardly from an opposite side thereof.

4. The apparatus of claim 3, each of said first and second pads having a bottom surface that is coplanar with the bottom surface of said base, each of said first and second pads being adjacent said rearward end of said base.

5. The apparatus of claim 1, said first arm being pivotally connected to said base in a location that is closer to said rearward end than a location that said second arm is pivotally connected to said base.

6. The apparatus of claim 1, further comprising:

a first pair of plates affixed to said base and extending upwardly therefrom, said first arm being pivotally connected between said first pair of plates; and a second pair of plates affixed to said based and extending upwardly therefrom, said second arm being pivotally connected between said second pair of plates.

7. The apparatus of claim 1, said first arm residing adjacent to a side of and rearward of said second arm when said first arm and said second arm are in the first position.

8. The apparatus of claim 1, said first arm having an end away from said base when in said second position, said second arm having an end away from said base when in said second position, said ends of said first and second arms having no structure therebetween.

9. An apparatus for maintaining a bag in an open configuration, the apparatus comprising:

a base having a forward end and a rearward end;

a first arm pivotally mounted adjacent said rearward end of said base, said first arm movable between a generally horizontal first position and a second position extending at an obtuse angle with respect to said base;

a second arm pivotally mounted adjacent said rearward end of said base in spaced relation to said first arm, said second arm movable between a generally horizontal first position and a second position extending at an obtuse angle with respect to said base, said first and second arms adapted to receive an open end of the bag thereon;

a first pin assembly connecting said first arm to said first pair of plates; and a second pin assembly connecting said second arm to said second pair of plates, each of said first and second pin assemblies comprising:

at least one tube having an inner wall, the tube affixed to the arm and extending through at least one of the pair of plates; and a first insert element engaged within an interior of the tube, said first insert element having a surface bearing against the one of the pair of plates.

10. The apparatus of claim 9, the tube having a shoulder element formed inwardly of one end of the tube, said first insert element having a conical portion having a shoulder bearing against said shoulder element of said tube.

11. The apparatus of claim 9, each of the plates of said first and second pair of plates having a J-shaped slot having an upper end and a lower end and a bottom surface between said first and second ends, the pin assembly residing against said bottom surface when the arm is in the second position, the pin assembly residing against said lower end of said J-shaped slot when the arm is in the first position.

12. An apparatus comprising:

a base having a forward end and a rearward end;

a first arm pivotally mounted adjacent said rearward end of said base, said first arm movable between a generally horizontal first position and a second position extending at an obtuse angle with respect to said base;

a second arm pivotally mounted adjacent said rearward end of said base in spaced relation to said first arm, said second arm movable between a generally horizontal first position and a second position extending at an obtuse angle with respect to said base; and a bag having a closed end and an open end, said open end having an interior surface positioned against said first and second arms when said first and second arms are in the second position, said base having a first slot and a second slot adjacent said rearward end of said base, said first arm having an end received in said first slot when said first arm is in said second position, said second arm having an end received in said second slot when said second arm is in said second position.

13. The apparatus of claim 12, said base adapted to be positioned against an underlying surface, said interior surface of said bag being interposed between a bottom of said base and the underlying surface.

14. The apparatus of claim 12, said interior surface of said bag bearing against ends of said first and second arms when said first and second arms are in the second position.

15. The apparatus of claim 12, said bag being a trash bag, said open end of said trash bag opening so as to face toward said first and second arms and said base.

16. The apparatus of claim 12, said base having a planar bottom surface and a top surface that is inclined upwardly from said forward end toward said rearward end, said rearward end of said base positioned interior of said bag.

17. The apparatus of claim 12, said base having a first pad extending outwardly from one side thereof and a second pad extending outwardly from an opposite side thereof, a first slot being formed between said first pad and said base, a second slot being formed between said second pad and said base, said bag having an edge at said open end thereof positioned in said first and second slots.

* * * * *